US005113332A

United States Patent [19]

Richardson

[11] Patent Number: 5,113,332

[45] Date of Patent: * May 12, 1992

[54] SELECTABLE MECHANICAL AND ELECTRONIC PATTERN GENERATING APERTURE MODULE

[75] Inventor: Brain E. Richardson, San Jose, Calif.

[73] Assignee: Morpheus Lights, Inc., San Jose, Calif.

[ * ] Notice: The portion of the term of this patent subsequent to Jan. 2, 2007 has been disclaimed.

[21] Appl. No.: 356,105

[22] Filed: May 24, 1989

[51] Int. Cl.[5] ..... F21V 11/00

[52] U.S. Cl. ..... 362/282; 362/324; 362/284

[58] Field of Search ..... 350/331 R; 353/122, 353/110; 362/268, 276, 280, 284, 323, 324

[56] References Cited

U.S. PATENT DOCUMENTS

| | | | |
|---|---|---|---|
| 3,757,106 | 9/1973 | Bau et al. | 240/10 R |
| 4,294,524 | 10/1981 | Stolov | 353/122 |
| 4,627,696 | 12/1986 | Sacher | 353/110 |
| 4,812,034 | 3/1989 | Mochizuki et al. | 353/122 |
| 4,832,461 | 3/1989 | Yamagishi et al. | 353/122 |
| 4,891,738 | 1/1990 | Richardson et al. | 362/284 |
| 4,899,267 | 2/1990 | Mardon | 362/284 |

FOREIGN PATENT DOCUMENTS

| | | |
|---|---|---|
| 0072303 | 2/1983 | European Pat. Off. . |
| 803846 | 4/1951 | Fed. Rep. of Germany . |
| 2089373 | 1/1972 | France . |

*Primary Examiner*—Ira S. Lazarus
*Assistant Examiner*—Sue Hagarman
*Attorney, Agent, or Firm*—Skjerven, Morrill, MacPherson, Franklin & Friel

[57] ABSTRACT

A lighting system aperture mechanism formed by a movable carriage including a frame with openings for mechanically formed or electronic pattern apertures. The frame is moved to position a selected opening around a beam of light and the pattern aperture disposed within the selected opening may be rotated as desired to produce special effect patterns in the beam of light.

23 Claims, 4 Drawing Sheets

OA
40
41
42l
42r
43l
46l
46r
47l
47r
48l
48r
49l
141l
141r
142l
142r
143l
143r
144l
144r
145l
145r
146r
148
150
151
152
153
154
155
156
157
158
159
160
162
164
166
168
170

SELECTABLE MECHANICAL AND ELECTRONIC PATTERN GENERATING APERTURE MODULE

BACKGROUND OF THE INVENTION

1. Field of the Invention

The present invention relates generally to optical aperture mechanisms and more particularly to a mechanism including multiple selectable and rotatable pattern apertures or transparent liquid crystal displays.

This application is related to copending application Ser. No. 07/224,438 filed Jul. 26, 1988, now U.S. Pat. No. 4,891,738, issued Jan. 2, 1990, entitled "Selectable Aperture Module", assigned to the assignee of the present invention.

2. Discussion of the Prior Art

Conventional theatrical and display lighting systems have used various types of optical filters which are removably insertable into light beams to modify the distribution of light in the projected beam. U.S. Pat. No. 2,214,728 describes a color wheel which includes several optical filters and which is rotatable to position a selected filter across a beam of light. The several filters have equal areas with uniformly dense coloring and do not produce different shapes in the projected beam of light.

U.S. Pat. No. 1,449,122 describes a kaleidoscope projector including several hollow tubes that are lined with different numbers of mirrors and supported in a frame which is rotatable to position a selected tube around light in a beam along an optical axis. Tube rotation gears are used to turn the selected tube of mirrors to spin the kaleidoscopic beam around the optical axis. However, the rotatable mirror tubes cannot stencil patterns into the beam, which requires a pattern aperture in a focal plane of the projector. The beam of light may be conventionally patterned by a strip of film scrolled across the beam between opposite side spools.

U.S. Pat. No. 3,030,856 describes a kaleidoscope projector which forms variable apertures using a pair of main disks each supporting a plurality of smaller disks around its periphery. Each smaller disk has translucent apertures spaced regularly around its own periphery. The main disks and each of the smaller disks are simultaneously rotated to continuously, and practically uncontrollably, vary the effective aperture shape and the pattern of light in the beam projected from the kaleidoscope.

U.S. Pat. No. 4,232,359 describes an illumination system including a plurality of shutters having edges or patterns of desired shapes, one or more of which may be manually inserted into, and remain fixed at a respective location in, a beam of light.

U.S. Pat. No 4,460,943 describes a light projector including a disc which has a number of openings for mounting "gobos" (stencils for light) and which is rotatable to insert a selected gobo into the focal plane of a beam of light.

Liquid crystal displays (LCD) have been used in a wide variety of different projection and display applications. U.S. Pat. Nos. 4,195,915 and 4,443,819 describe using a reflective type LCD to project television images. U.S. Pat. Nos. 4,222,641, 4,294,524 and 4,368,963 describe a projector system which projects light through a stationary transparent LCD onto a cinema screen. U.S. Pat. Nos. 3,722,988, 3,844,650, 3,895,866, 4,671,634, 4,722,593, 4,756,604 and 4,345,258 all describe various types of transparent LCD projectors where the LCD is fixed in a stationary position.

U.S. Pat. No. 4,568,080 describes a transparent LCD display in which the LCD may be placed in a number of different operative positions. However, once the LCD is affixed in a particular position it may not thereafter be moved to a different position without dismantling the display system. Hence, none of the above prior art teaches or suggests automatically positioning the LCD in front of a light beam or selectively interchanging that LCD with a number of mechanically formed apertures so as to controllably vary the projected pattern of light.

U.S. Pat. Nos. 4,693,557 and 4,613,207 describe a motion picture projector in which a continuous strip of transparent liquid crystal material capable of temporarily storing charge is utilized to create a series of picture frames for projection onto a screen. As each frame is created and projected, it is moved out of the way and the next frame is moved into the projection optics for projection. Images are created on the liquid crystal material by passing the liquid crystal material beneath a dynamic electrode, formed in the shape of a roller, which charges selective portions of the LCD so as to form the desired images. In both of these patents, no provision is made to project light onto the screen in any other manner than through the liquid crystal material.

SUMMARY OF THE PRESENT INVENTION

It is therefore a primary objective of the present invention to provide an aperture apparatus including multiple pattern aperture means which are selectively and automatically positionable and rotatable around an optical axis.

Another objective is to provide a unitary and flexibly operable aperture apparatus for performing functions previously requiring separate aperture apparatuses.

A further objective is to provide an aperture apparatus including means for selectively and automatically positioning a transparent LCD within a projection light beam.

Briefly, a preferred embodiment of the invention is formed from base means, carriage means including frame means which has multiple openings and which is movably supported on said base means, multiple pattern aperture means formed by aperture plates and aperture holders rotatably engaged adjacent respective ones of said openings, frame drive means for selectively moving said frame means to center a selected opening around an optical axis, and aperture drive means for spinning a certain selected pattern aperture means centered on the optical axis. Alternatively, one or more of the pattern aperture means may be replaced by a nonrotatable electronic aperture means capable of creating an unlimited variety of patterns.

The present invention has the advantage that certain selected pattern aperture means can be spun, in a desired direction at a desired speed, to produce special effect patterns in a beam of light projected therethrough.

These and other objects of the present invention will become apparent to those skilled in the art upon reading the following detailed description of the preferred embodiment as shown in the accompanying drawing figures.

DETAILED DESCRIPTION OF THE PREFERRED EMBODIMENT

Figure 1:
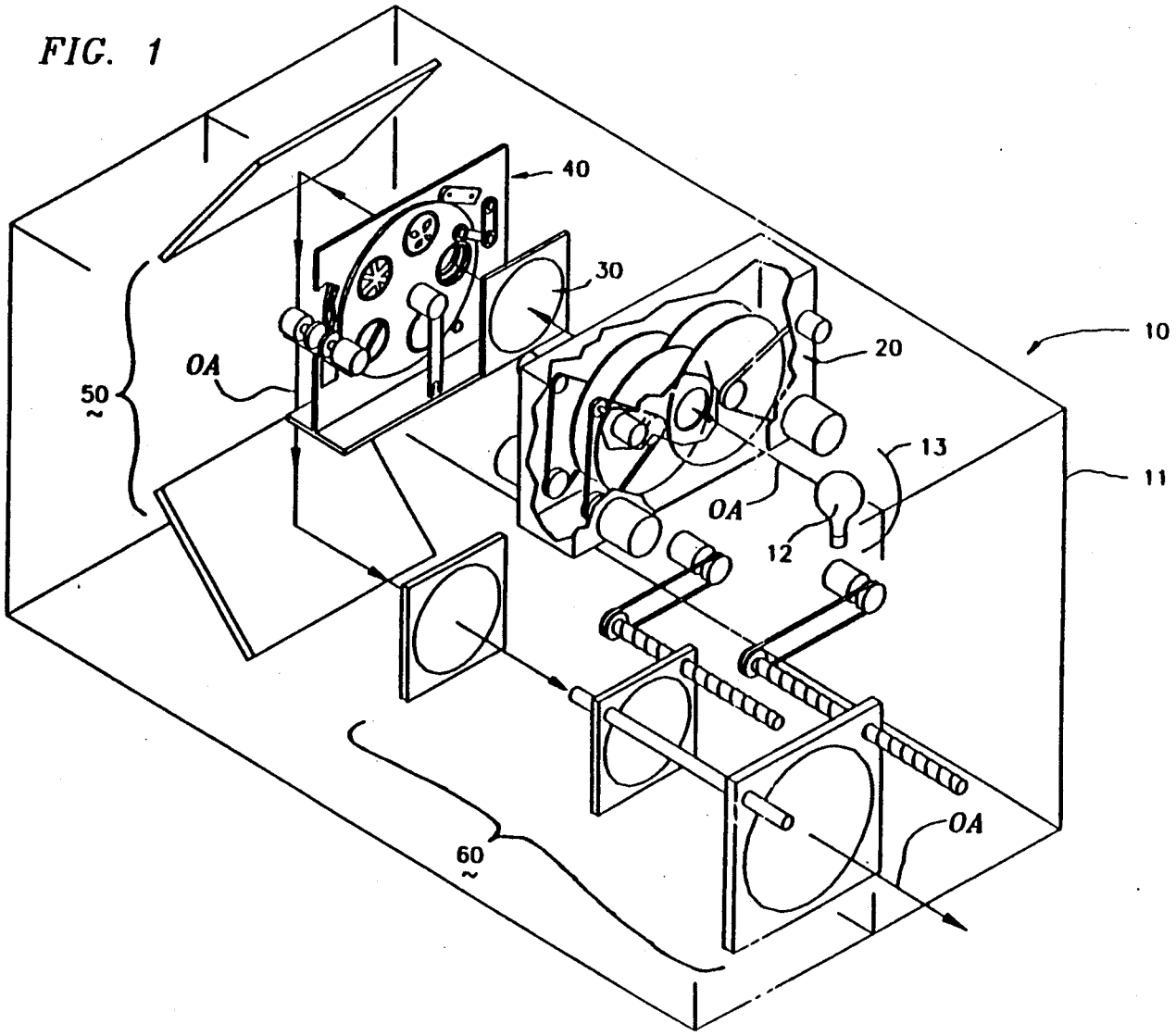
FIG. 1 is an isometric view of a lighting system including a preferred embodiment of a selectable aperture module according to the present invention.

The present invention is preferably embodied in a selectable aperture module 40 which may be used in the context of a spot light projection system 10 as illustrated in FIG. 1. System 10 is mounted within a (schematically outlined) housing 11 and includes a light source such as a short arc lamp 12 with a parabolic reflector 13 which radiates light around optical axis OA (leftward in FIG. 1). The radiated light is conventionally filtered through a "hot filter" (not shown) which removes infra-red and ultra-violet light while passing visible light. The visible light in a beam is preferably passed through a spectral filtering module 20 which controls its color and intensity as disclosed in Applicant's co-pending application Ser. No. 224,436 filed Jul. 26, 1988, now U.S. Pat. No. 4,914,556, issued Apr. 3, 1990.

Downstream from filtering module 20, the filtered light beam is preferably diffused through an acid-etched glass plate diffusor (not shown). The optionally filtered and diffused light beam is then passed through a condenser lens 30 which focuses the beam downstream towards selectable aperture module 40.

Aperture module 40 holds multiple apertures in one or more planes normal to axis OA at or near a focal point of lens system 60. A selected aperture is positioned to be intersected by the beam of light as described below.

Between various elements of system 10 the light beam may be reflected by one or more mirrors in a beam folding means 50 to minimize the size of the housing 11. Downstream from aperture module 40 the patterned beam of light traverses zoom lens system 60, whereby the beam is focused and projected from system 10 as further described in Applicant's co-pending application Ser. No. 224,437 filed Jul. 26, 1988, now U.S. Pat. No. 5,029,992, issued Jul. 9, 1991. The beam axis may be directed as desired by vertically tilting and/or horizontally panning housing 11.

Figures 2, 3, 4, 5:
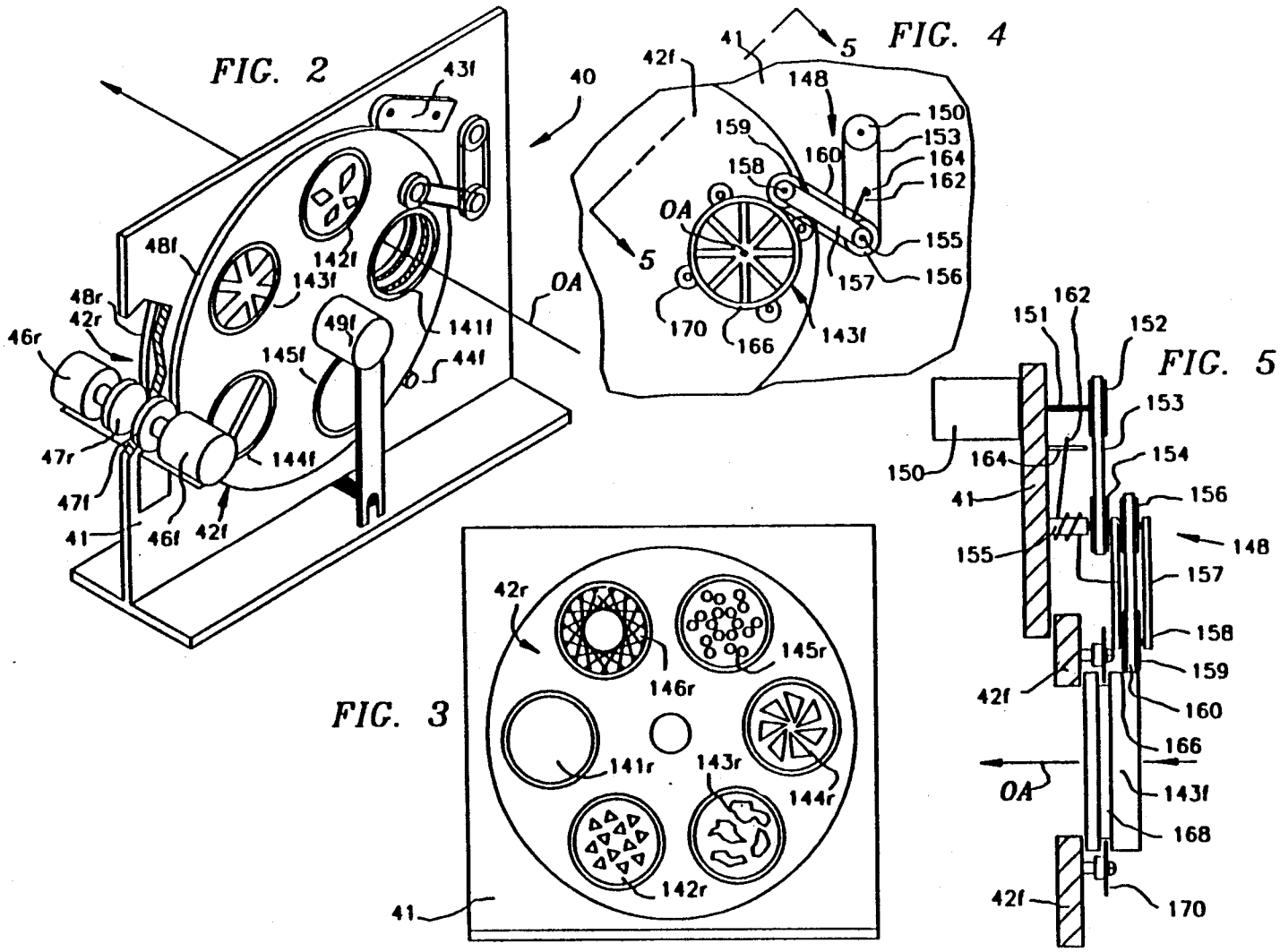
FIG. 2 is an isometric view of the selectable aperture module of FIG. 1.
FIG. 3 is a rear elevational view of a FIG. 2 frame wheel engaging example pattern aperture means.
FIG. 4 is a front elevational view of the FIG. 2 aperture drive mechanism.
FIG. 5 is a cross-sectional view taken along line 5—5 through the FIG. 4 aperture drive mechanism and, for the sake of clarity, omitting the rear frame wheel.

Referring to FIG. 2, selectable aperture module 40 includes a base panel 41, carriage means including a first or front frame or carousel wheel 42F and preferably a second or rear frame or carousel wheel 42R. Spring-loaded guide rollers (43F) in the front and (not shown) in the rear urge frame wheels 42F and 42R against fixed guide rollers (44F) in the front and (not shown) in the rear. Frame drive motors 46F and 46R, which may be analog DC servo motors or digital AC stepper motors, turn drive rollers 47F and 47R whose friction against rims 48F and 48R turns wheels 42F and 42R. Analog servo motor operations cause wheel movements which are preferably sensed by axially-connected potentiometers (49F) in the front and (not shown) in the rear.

Front wheel 42F has, equally spaced in five sectors, one circular opening 141F which is left empty for entirely passing a beam of light and four circular openings which are used to engage aperture holders of aperture means 142F through 145F including pattern aperture plates for patterning the beam of light.

Referring to FIG. 3, rear wheel 42R has, equally spaced in six sectors, one circular opening 141R which is left empty and five circular openings which are used to engage aperture holders of aperture means 142R through 146R.

FIGS. 4 and 5 show front wheel 42F in a different rotational position where pattern aperture means 143F is intersected by light in a beam around axis OA. Frame wheel 42F is provided with a holder drive mechanism 148 comprising a motor 150 with a shaft 151 attached to a pulley 152 which engages a belt 153 looped around a pulley 154. A fixed sleeve 155 has a hollow core containing bearings supporting a rotatable shaft which is attached between pulley 154 and a pulley 156. Sleeve 155 is pivotally connected to one end of a rigid link 157 which has its other end pivotally connected to a sleeve 158, similarly containing bearings and a rotatable shaft which is in turn attached to a pulley 159. Pulleys 156 and 159 are encircled by a belt 160. A spring 162 is disposed around sleeve 155 with one end compressed against a stop peg 164 and the other end compressed against link 157. Spring 162 acts through link 157, sleeve 158 and pulley 159 to force belt 160 against rim 166 of holder 143F. Aperture holder rim 166, for example, has a groove 168 guided by washers on pins 170.

In operation, frame drive motors 46F and/or 46R are selectively operated in either direction at selected speed(s) to move frames 42F and/or 42R to desired positions. Analog DC servo-motors are preferably controlled by analog or appropriately converted digital signals fed back from potentiometers or encoders 49. Drive motor 46 operations may optionally be further controlled by a programmed microprocessor (not shown).

When frame wheels 42R and/or 42F are positioned with selected aperture means (143F for example) centered on optical axis OA the selected front aperture holder may be spun by holder drive mechanism 148. Motor 150 is selectively operated in either direction at a selected speed to turn belt 160 against rim 166 of the aperture holder and spin the pattern aperture plate intersected by the beam of light around axis OA.

Figure 6:
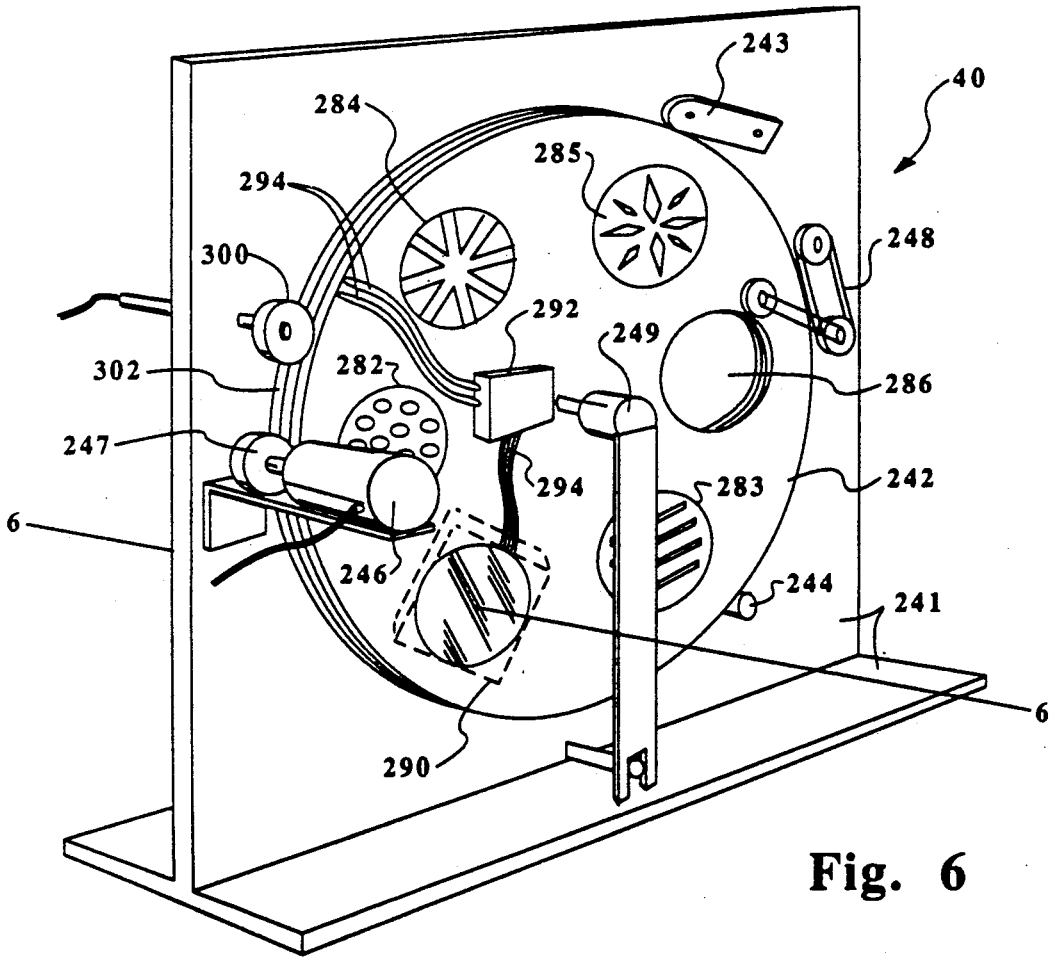
FIG. 6 is an isometric view of an alternative embodiment of the selectable aperture module of FIG. 1 incorporating an electronic aperture means.

FIG. 6 illustrates an alternative embodiment of the selectable aperture module 40 of FIG. 1, having a variable electronic aperture means incorporated into the carousel or frame wheel. Selectable aperture module 40 includes a base panel 241, a carriage means including at least a first or front frame or carousel wheel 242 and preferably a second or rear frame or carousel wheel (not shown in FIG. 6, but shown in FIG. 2). A spring-loaded guide roller 243 urges the frame wheels 242 against the fixed guide rollers 244. A frame drive motor 246, such as an analog DC servo motor or a digital AC stepper motor, turns drive rollers 247, whose friction against rim 302 turns wheel 242. If a servo motor is used to drive the frame wheel 242, its rotational movement is preferably sensed by axially-connected potentiometer 249 in order to provide feedback control.

Frame wheel 242 has, equally spaced in six sectors, six circular openings which may be used to engage aperture holders of aperture means 282 through 286 or left empty as a circular opening 281 for entirely passing a beam of light therethrough, as discussed above in the preferred embodiment of the present invention. Alternatively, one or more of the circular openings could be used to form an optically restricting frame around a portion of an electronic aperture means 290, such as a transparent type LCD or similar type of device. It should be noted that holder drive mechanism 248 would not be utilized when a non-rotatable electronic aperture means is positioned within one of the circular openings.

When an LCD is placed within one of the circular openings of the frame wheel 242, depending on the type of LCD and how it is connected, an LCD driver and multiplexer circuit 292 may be required to receive certain electrical signals over wires 294, separate those electrical signals from one another, and then transfer those electrical signals over tape or ribbon connector 294 to LCD 290.

In the illustrated example of FIG. 6, frame wheel 242 is designed to be freely rotatable within base panel 241. Hence, it is essential that frame wheel 242 not be connected to any nonrotatable mechanical or electrical components which would impede its ability to freely rotate. Accordingly, electrical connectivity means 300 is comprised of an electrically coupled roller having two conductor lines which maintain constant contact with two mating conductor lines on rim 302. Since all of the electrical signals input to driver circuit 292 are sequential in time, the driver circuit 292 must also have multiplexing capabilities so that it may separate these sequential signals and apply them to the LCD 290 over cable 296.

Figure 7:
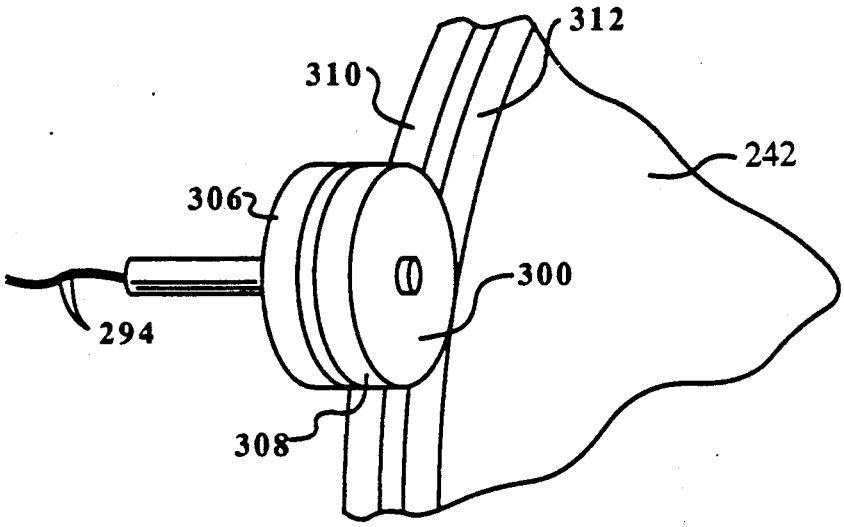
FIG. 7 is a partially-broken perspective view of the electrical connectivity means of the alternative embodiment of the aperture module of FIG. 6.

The interaction between electrical connectivity means 300 and rim 302 is illustrated in FIG. 7. A main processing system (not shown) determines what charges need to be applied to the LCD 290 in order to create a desired pattern through which light will be projected. The processing system then multiplexes these signals and outputs them over wires 294 to electrical connectivity means 300. First conductor band 306 and second conductor band 308 are respectively connected to one of the wires 294 and are wound around the roller of electrical conductor means 300. As the roller 300 moves with the movement of rim 302, conductor bands 306 and 308 remain in contact with matching first and second conductors 310 and 312 respectively, thereby maintaining a constant electrical connection between the processing system and LCD driver 292.

It should also be noted that since the amount of power required to run LCD driver 292 and LCD 290 is low, many other types of connectivity means, such as optical links or brush connectors, could be utilized in place of the means shown to achieve the same purpose.

Figure 8:
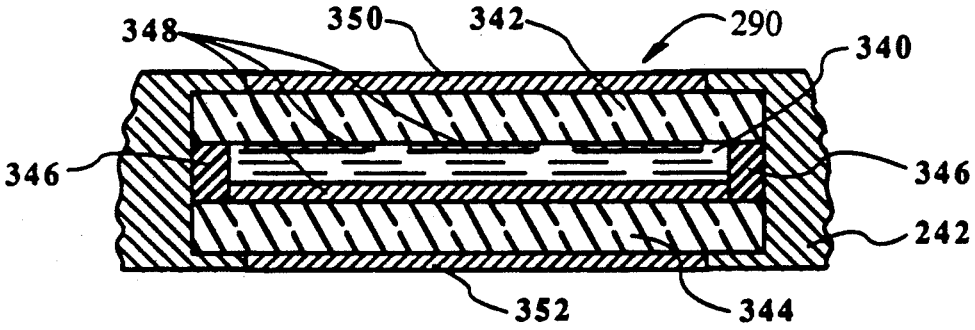
FIG. 8 is a partially-broken cross-sectional view taken along the line 6—6 through the electronic aperture means of FIG. 6.

FIG. 8 illustrates a cross-sectional view taken along line 6—6 through the electronic aperture means 290 of FIG. 6. The type of electronic aperture illustrated is a twisted nematic mode (TN) LCD. Other types of LCD which can be utilized in place of the TN mode LCD include the dynamic scattering mode, guest host mode, and phase shift mode. LCD's are basically electronic shutters, in that they are transparent when no voltage is applied and opaque when voltage is applied.

LCD 290 is formed from a layer of liquid crystal molecules 340 sealed between two glass substrates, front glass substrate 342 and rear glass substrate 344. Prior to being layered together, electrodes 348 are affixed to the liquid crystal side of the two substrates so that electrical charges are directly applied to the liquid crystals. For instance, a ground electrode is affixed to rear glass substrate 344 and a number of positive charge electrodes 348 are affixed to front glass substrate 342, so that electrical charges can be separately applied to various different areas on the LCD. A seal 346 is used to retain the liquid crystals within the substrate layers.

The substrate layers are then sandwiched between a front polarizer 350 and a rear polarizer 352 and placed within an opening of frame wheel 242. It should be noted that LCD 290 has only been shown in a rectangular configuration which is actually imbedded in frame wheel 242 for illustrative purposes. LCD 290 could have just as easily been produced in a rounded configuration which could be readily inserted and removed from the opening in frame wheel 242.

When no voltage is applied to the electrodes 348, the liquid crystal molecules align themselves at a 90 degree angle to the axis of the light beam so as to rotate the plane of polarization of the light by 90 degrees, thereby allowing light to pass through both polarizers 350 and 352. When a voltage is applied to an electrode, the molecules of the liquid crystal material coming directly between the charged electrode and the ground electrode are realigned perpendicular to the substrate, so that the portion of the light beam impinging upon that area of the LCD is cut off by one of the polarizers. To form a desired image, separate charges are applied to different points throughout the LCD so as to only selectively block light from passing through some areas.

Use of an LCD in the present invention allows an operator to create an unlimited number of different patterns through which a bean of light may be passed. In contrast, metal etched apertures, such as aperture means 282 through 285, limit the quantity of patterns which can be created without disassembling the projection system 10. Although it would seem desirable to replace all of the metal etched apertures with electronic apertures, such as LCD 290, presently available LCD's, however, utilize polarization filters which reduce the intensity of light passing through the aperture by up to 50% and have a tendency to create visual distortions when exposed to high intensity light sources over an extended period of time. Thus, it is essential to the present invention that the electronic aperture means be used in combination with other pattern apertures or openings, such that no one electronic aperture is overly exposed to a high intensity light source and such that higher intensity light sources may be utilized.

Although the present invention has been described in a preferred embodiment, it will be appreciated by those skilled in the art that this embodiment may be modified without departing from the essence of the invention. For example the carriage means may include a straight frame which is linearly slidable across the axis of a beam, or a paddle-wheel type frame which is rotatable to position a selected paddle with an aperture holder across the axis of a beam. It is therefore intended that the following claims be interpreted as covering any modifications falling within the true scope and spirit of the invention.

I claim:

1. A selectable aperture apparatus for use in a stage lighting system or the like, comprising:

base means;

means for movably supporting said base means and having formed therein a first opening and a second opening;

an electronic pattern aperture means disposed within said first opening in said supporting means for selectively forming a plurality of opaque patterns for modifying a beam of light travelling along an optical axis passed through said electronic pattern aperture means, said second opening being capable of allowing the transmission of a beam of light at substantially full intensity, with no significant attenuation therein; and drive means for controllably moving said supporting means in such a manner so that said first and second openings are selectively intersected by said optical axis.

2. A selectable aperture apparatus as recited in claim 1 and further comprising means for remotely controlling the formation of said opaque patterns by said electronic pattern aperture means.

3. A selectable aperture apparatus as recited in claim 2 wherein said remote controlling means wirelessly communicates with said electronic pattern aperture means to selectively control formation of said opaque patterns.

4. A selectable aperture apparatus as recited in claim 3 wherein said remote controlling means is in hard-wire communication with said electronic pattern aperture means to selectively control formation of said opaque patterns.

5. A selectable aperture apparatus as recited in claim 2 wherein said remote controlling means includes:

means for remotely creating electrical signals corresponding to electrical charges necessary to form said opaque patterns;

electrical driver means for receiving said electrical signals and inputing said electrical signals to said electronic pattern aperture means; and communicating means for movably hard-wire connecting said remote creating means and said electrical driver means.

6. A selectable aperture apparatus as recited in claim 5 wherein said supporting means comprises carousel wheel means rotatably supported on said base means and wherein said communicating means includes:

first conductor means affixed to said carousel wheel for receiving said electrical signals and communicating said electrical signals to said electrical driver means; and second conductor means for receiving said electrical signals from said remote creating means and for movably engaging said first conductor means to maintain a constant electrical contact between said first and second conductor means through which said electrical signals may pass.

7. A selectable aperture apparatus as recited in claim 1 wherein said supporting means comprises carousel wheel means rotatably supported on said base means.

8. A selectable aperture apparatus as recited in claim 7, wherein said supporting means has a plurality of additional openings formed therein, and further comprising a plurality of mechanically formed pattern aperture means each coaxially disposed adjacent and rotatably relative to a respective one of said additional openings in said supporting means.

9. A selectable aperture apparatus as recited in claim 8 wherein said second opening in said supporting means is left open so as to freely let said beam of light pass therethrough.

10. A selectable aperture apparatus as recited in claim 1 wherein said supporting means comprises two coaxially supported supporting means independently positionable with respect to one another, wherein each of said supporting means has a first opening and a second opening, and wherein at least one of said supporting means has one of said electronic aperture means disposed within said first opening therein.

11. A selectable aperture apparatus as recited in claim 10, wherein each of said supporting means has a plurality of additional openings formed therein, and each said supporting means further comprises a plurality of mechanically formed pattern aperture means each coaxially disposed adjacent and rotatably relative to a respective one of said additional openings in said supporting means.

12. A selectable aperture apparatus as recited in claim 11 wherein said second opening in each of said supporting means is left open so as to freely let said beam of light pass therethrough.

13. A selectable aperture apparatus as recited in claim 1 wherein said electronic pattern aperture means is a liquid crystal display device.

14. A selectable aperture apparatus as recited in claim 13, wherein said electronic pattern aperture means is a twisted nematic type liquid crystal device.

15. A selectable aperture apparatus as recited in claim 13, wherein said electronic pattern aperture means is a dynamic scattering type liquid crystal device.

16. A selectable aperture apparatus as recited in claim 1 wherein said drive means comprises analog servo motor means and potentiometer means which sense operations of said motor means and in response thereto provide signals for feedback control of said motor means.

17. Apparatus as in claim 1 wherein said drive means comprises digital stepper motor means.

18. Apparatus as in claim 17 wherein said drive means further comprises encoder means which sense operations of said motor means and in response thereto provide digital signals for feedback control of said motor means.

19. A selectable aperture apparatus as recited in claim 1 wherein said supporting means has a plurality of additional openings formed therein, and further comprising a plurality of mechanically formed pattern aperture means each coaxially disposed adjacent and rotatably relative to a respective one of said additional openings in said supporting means.

20. A selectable aperture apparatus as recited in claim 19 and further comprising aperture drive means for controllably rotating one of said mechanically formed pattern aperture means intersected by said optical axis to further modify said beam of light.

21. A selectable aperture apparatus as recited in claim 20 wherein said aperture drive means comprises motor means supported by said base means so as to apply frictional drive forces to one of said mechanically formed pattern aperture means centered on said optical axis.

22. A selectable aperture apparatus as recited in claim 1 wherein said electronic pattern aperture means is coaxially disposed adjacent and rotatably relative to said first opening in said supporting means.

23. A selectable aperture apparatus as recited in claim 22 an further comprising aperture drive means for controllably rotating said electronic pattern aperture means when centered on said optical axis.

* * * * *